US005459315A

United States Patent [19]

Waki

[11] Patent Number: 5,459,315

[45] Date of Patent: Oct. 17, 1995

[54] QUADRUPOLE MASS ANALYZER INCLUDING SPRING-CLAMPED HEAT SINK PLATES

[75] Inventor: Hiroaki Waki, Kyoto, Japan

[73] Assignee: Shimadzu Corporation, Kyoto, Japan

[21] Appl. No.: 338,168

[22] Filed: Nov. 10, 1994

[30] Foreign Application Priority Data

Nov. 18, 1993 [JP] Japan ..... 5-314394

[51] Int. Cl.[6] ..... H01J 49/42

[52] U.S. Cl. ..... 250/292; 250/290

[58] Field of Search ..... 250/281, 282, 250/290, 292, 396 R

[56] References Cited

U.S. PATENT DOCUMENTS

| | | | |
|---|---|---|---|
| 3,371,205 | 2/1968 | Berry | 250/292 |
| 4,032,782 | 6/1977 | Smith et al. . | |
| 4,731,533 | 3/1988 | Vestal | 250/292 |
| 4,885,470 | 12/1989 | Abbott | 250/396 R |

FOREIGN PATENT DOCUMENTS

| | | | |
|---|---|---|---|
| 2434090 | 2/1976 | Germany | 250/292 |
| 0098448 | 6/1984 | Japan | 250/292 |
| 2138201 | 10/1984 | United Kingdom . | |

OTHER PUBLICATIONS

Patent Abstracts of Japan, vol. 8, No. 213 (E–269), Sep. 28, 1984, Yasutaka Masatoshi, "Quadrupole Mass Spectrometer" (JP–A–59–098–448).

Patent Abstracts of Japan, vol. 16, No. 112, (E–1180), Mar. 19, 1992, Norio Kameshima, "Quadruople Mass Spectrometric Device" (JP–A–03–285–246).

Patent Abstracts of Japan, vol. 15, No. 3 (E–1019), Jan. 7, 1991, Hiroto Itoi, "Multipolar Electrode" (JP–A–02–257–558).

*Primary Examiner*—Jack I. Berman
*Assistant Examiner*—James Beyer
*Attorney, Agent, or Firm*—Oliff & Berridge

[57] ABSTRACT

A quadrupole mass analyzer in which a pair of heat sink plates 16, 17 and springs 18 clamp ceramic holders 13, 14 that hold the four rod electrodes 12 of the quadrupole unit. The dielectric heat generated in the ceramic holders 13, 14 by the high frequency alternating electromagnetic field due to the AC voltage applied on the four rod electrodes 12 is promptly transferred to the heat sink plates 16, 17. Thus displacement of the four rod electrodes 12 or loss of symmetry is prevented when mass of ions is analyzed.

12 Claims, 4 Drawing Sheets

QUADRUPOLE MASS ANALYZER INCLUDING SPRING-CLAMPED HEAT SINK PLATES

The present invention relates to a quadrupole mass analyzer, especially to the structure of the quadrupole unit.

BACKGROUND OF THE INVENTION

A quadrupole mass analyzer includes a quadrupole unit 40, an ion detector 46 placed at an exit of the quadrupole unit 40, and a driver circuit 50, as shown in FIG. 5. A quadrupole unit 40 is composed of four rod electrodes 41, 42, 43, 44 placed in parallel to and symmetrically around the z axis. The driver circuit 50 applies both a direct current (DC) voltage U and a high frequency alternate current (AC) voltage V.cos(ω·t) simultaneously between a pair of electrodes 42 and 44 placed along the x axis and the other pair of electrodes 41 and 43 placed along the y axis. When ions are introduced into the center of an end of the quadrupole unit 40 while the DC/AC voltage is applied among the four rod electrodes 41, 42, 43, 44, only ions 45 having a specific mass can pass the quadrupole unit 40 and other ions 47 disperse before the ion detector 46. Since the specific mass of the ions that can pass through the quadrupole unit 40 is determined by the DC voltage U and the high frequency AC voltage V, the mass of ions 45 detected by the ion detector 46 can be scanned by changing the values of the voltages U and V with a certain correlation between them.

The four rod electrodes 41, 42, 43, 44 of the quadrupole unit 40 must be placed precisely symmetrically around the z axis to perform a correct mass analysis. Thus, conventionally, the four rod electrodes 41, 42, 43, 44 are securely held by a pair of ceramic holders 48 and 49 at both ends of the rod electrodes 41, 42, 43, 44, as shown in FIGS. 6 and 7, to prevent displacement of the rod electrodes within the quadrupole unit 40. Then the quadrupole unit 40 is inserted in a cylindrical case 52 as shown in FIG. 6, or placed on a base plate 53 as shown in FIG. 7, to correctly align with an ion entrance and with the ion detector 46 (not shown in FIGS. 6 and 7).

When the high frequency AC voltage is applied among the four rod electrodes 41, 42, 43, 44 as described above for a mass analysis, the ceramic holders 48 and 49 experience a high frequency alternating electromagnetic field, and heat is generated in the ceramic holders 48 and 49 due to the dielectric heating effect. As the temperature rises due to the dielectric heating, the ceramic holders 48 and 49 expand and sometimes distort, resulting in a displacement or a loss of symmetry of the rod electrodes 41, 42, 43, 44. In the conventional quadrupole mass analyzers as shown in FIGS. 6 or 7, the heat generated in the ceramic holders 48 and 49 hardly goes out because the area of contact between the cylindrical case 52 and the ceramic holders 48, 49 or between the base plate 53 and the holders 48, 49 is small and the cylindrical case 52 and the base plate 53 are made of stainless steel.

SUMMARY OF THE INVENTION

The present invention provides a quadrupole mass analyzer in which the displacement of the four rod electrodes is minimized and a correct mass analysis can be performed for a long time. The quadrupole mass analyzer according to the present invention includes:

four rod electrodes placed in parallel to and symmetrically around a center axis;

a pair of non-conductive holders for holding the four rod electrodes at both ends of the four rod electrodes; and a pair of heat sink plates and a unit of spring means for clamping the non-conductive holders.

When the quadrupole unit is used in a mass analysis, the DC/AC voltage is applied to the four rod electrodes, which produces high frequency alternating electromagnetic field around the rod electrodes and causes dielectric heating in the nonconductive holders. The heat generated in the non-conductive holders is promptly transferred to the pair of heat sink plates. This prevents a remarkable temperature rise in the non-conductive holders, and displacement of the rod electrodes within the quadrupole unit is minimized, which ensures a correct mass analysis for a long time.

It is preferable to match the shape of the contacting faces of the non-conductive holders and the heat sink plates to increase the area of contact of the two members. It is further preferable to make the contacting faces flat and parallel in order not to exert uneven forces to the non-conductive holders or to the quadrupole unit. The heat sink plates can be made of copper, aluminum, steel or other metals having a good heat conductivity.

Other features and details of the present invention are fully disclosed in the following description of the preferred embodiments.

DETAILED DESCRIPTION OF A PREFERRED EMBODIMENT

Figure 1:
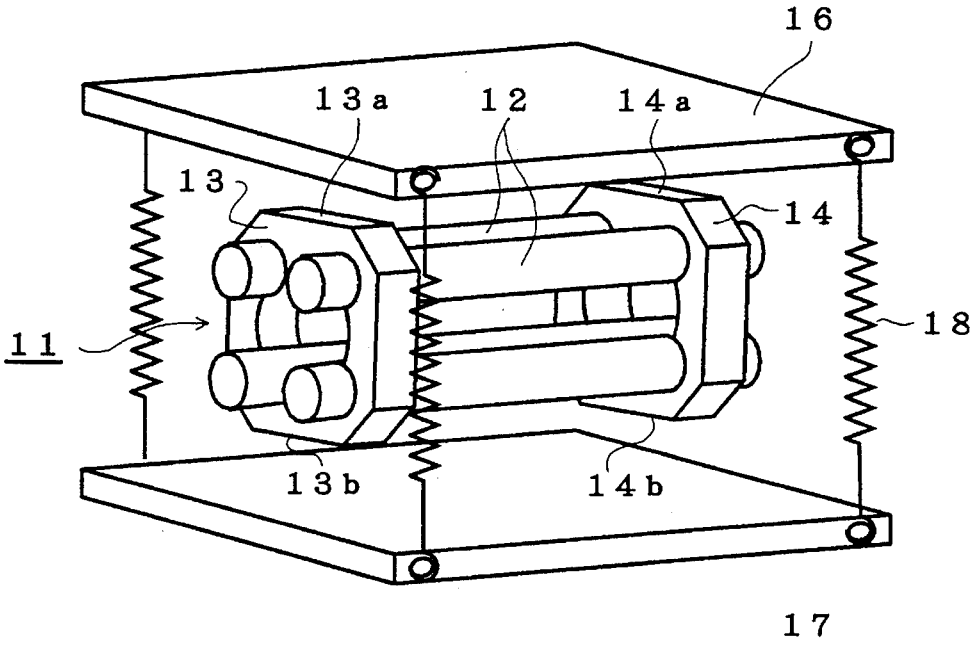
FIG. 1 is a perspective view of a quadrupole unit as the first embodiment of the present invention.

The first embodiment of the present invention is described using FIG. 1. A quadrupole unit 11 is made of four rod electrodes 12 placed symmetrically around an axis and fixed by a pair of ceramic holders 13 and 14 at both ends. The holders 13 and 14 are shaped octagonal, and have flat faces at the top and at the bottom (or at the left and at the right) 13*a*, 13*b*, 14*a* and 14*b*. The holders 13, 14 are then clamped by a pair of copper or aluminum heat sink plates 16, 17 with four springs 18, whereby the holders 13, 14 and the heat sink plates 16, 17 contact at sufficiently broad areas and no skewing force is exerted on the quadrupole unit 11 because the holders 13, 14 can slide on the flat surface of the heat sink plates 16, 17. The heat generated in the rod electrodes 12 and the holders 13, 14 by the dielectric heating during a mass analysis operation is transferred to the heat sink plates 16, 17 via the broad contacting faces whereby severe temperature rise of the holders 13, 14 is prevented.

Figure 6:
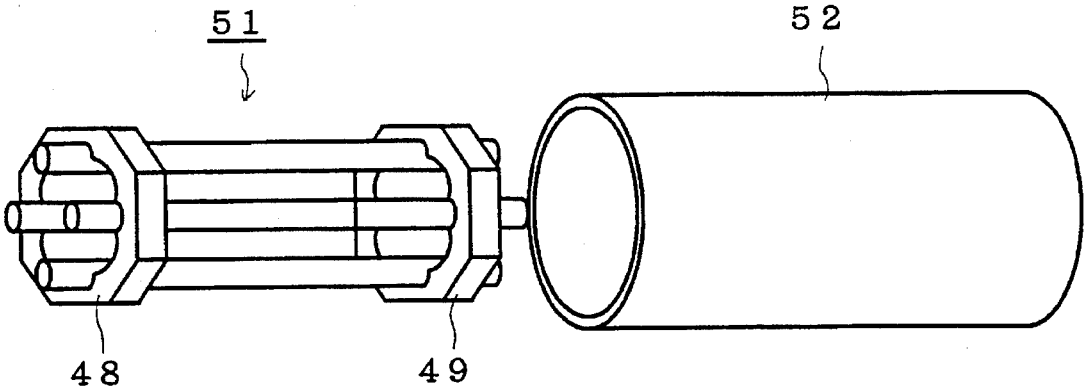
FIG. 6 is a perspective view of a conventional quadrupole unit using a cylindrical case.
Figure 7:
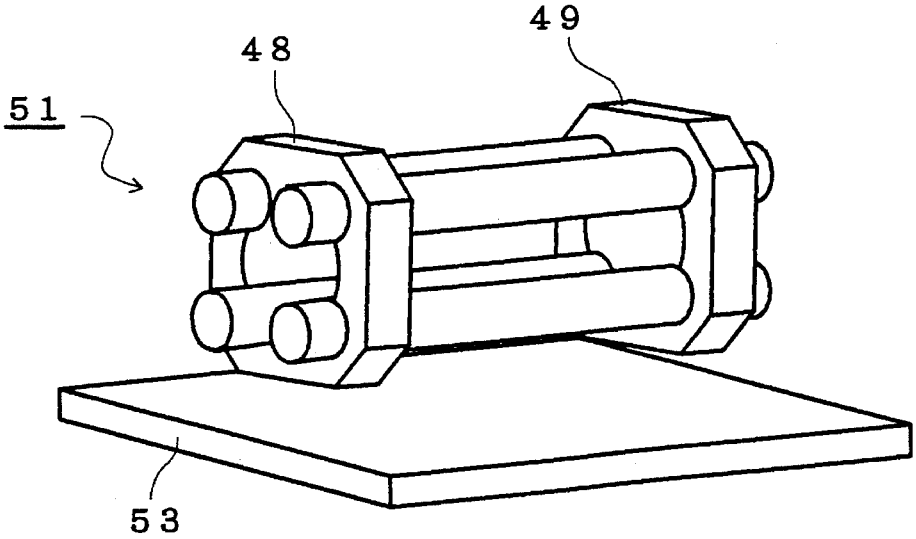
FIG. 7 is a perspective view of another conventional quadrupole unit using a base plate.

The quadrupole unit 11 clamped by the heat sink plates 16, 17 is then inserted in an appropriate case 52 as shown in FIG. 6 or placed on a base plate 53 as shown in FIG. 7. Since the position of the case 52 or the base plate 53 is fixed with respect to the ion entrance and the ion detector (not shown) taking account of the dimensions of the heat sink plates 16, 17, the quadrupole unit 11 aligns with the ion entrance and the ion detector so that ions coming through the ion entrance enter on the central axis of the quadrupole unit 11.

Figure 2:
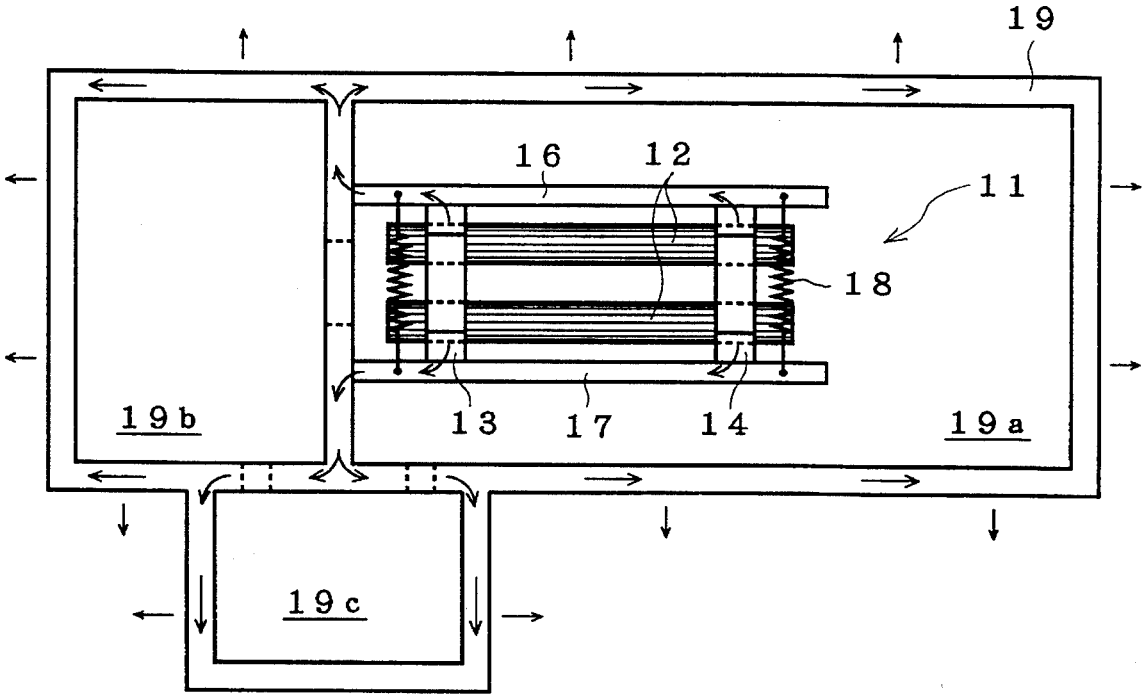
FIG. 2 is a side view of a quadrupole unit placed in and contacting to a heat conductive case.

When the quadrupole unit is installed in a mass analyzer, it is preferable to set the heat sink plates 16, 17 to contact a wall of the metal case 19 of the mass analyzer, as shown in FIG. 2. The heat transferred from the ceramic holders 13, 14 to the heat sink plates 16, 17 is then dissipated through the contacting face to the metal case 19. Since the metal case 19 of a mass analyzer normally has a large heat capacity, the heat is effectively drawn out of the heat sink plates 16, 17, which further prevent the temperature rise of the ceramic holders 13, 14 and the quadrupole unit.

Figure 3A:
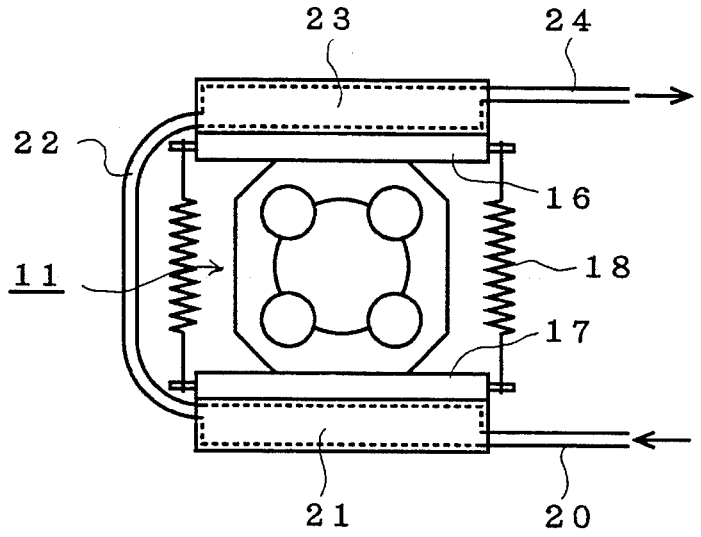
FIG. 3A is a front view of the second embodiment of the present invention which is equipped with a fluid cooling system.

The second embodiment of the present invention is shown in FIG. 3A in which a fluid cooling system is mounted on the heat sink plates 16, 17. The fluid cooling system includes a bottom heat exchanger 21, a top heat exchanger 23 and tubes 20, 22 and 24 for flowing coolant through them. It is preferable to flow the coolant from the bottom to the top.

Figure 3B:
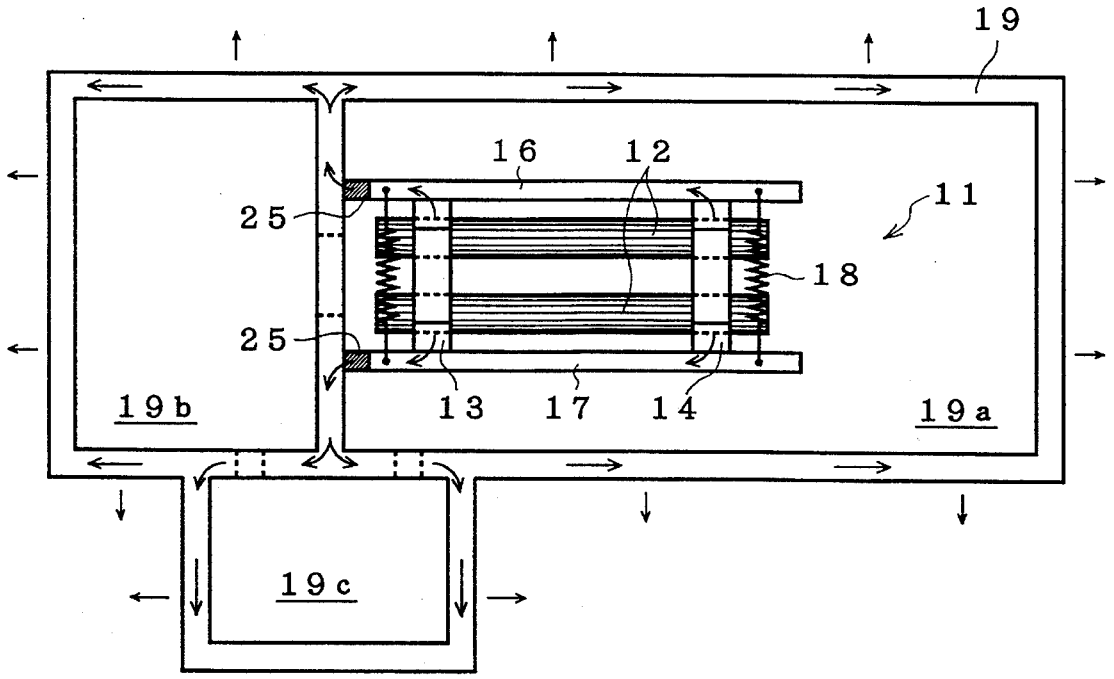
FIG. 3B is a side view of the third embodiment using Peltier heat pump units.

FIG. 3B shows the third embodiment of the present invention in which Peltier heat pump units 25 are used to actively draw heat from the heat sink plates 16, 17 and actively give the heat to the metal case 19 of the mass analyzer. In FIGS. 2 and 3B, numeral 19a denotes a mass filter section; 19b denotes an ion source section; 19c denotes a vacuum pump section; and the small arrows indicate the flow of heat.

Figure 4:
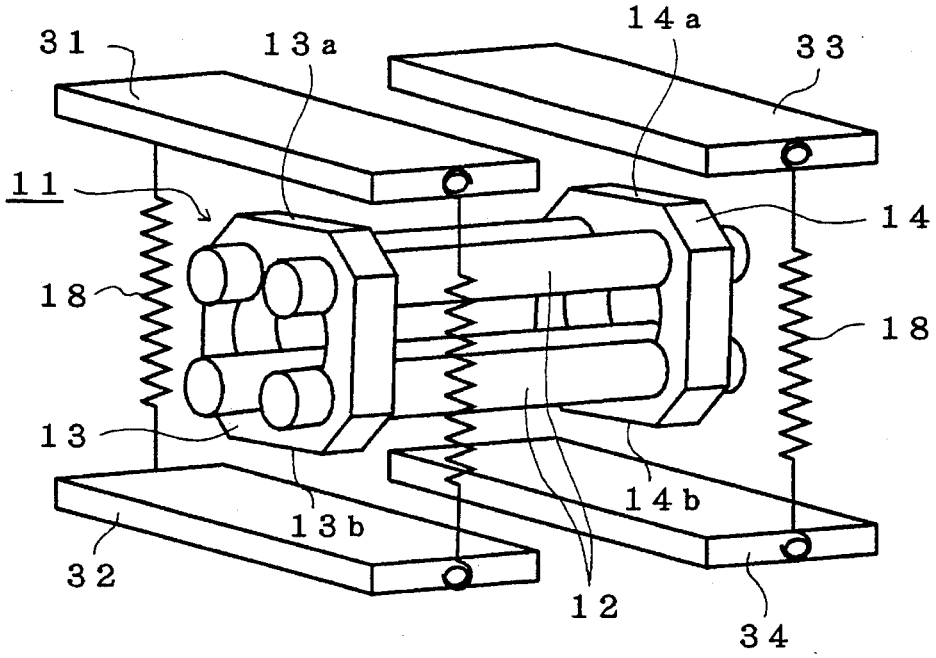
FIG. 4 is a perspective view of the fourth embodiment of the present invention which has separate heat sink plates.
Figure 5:
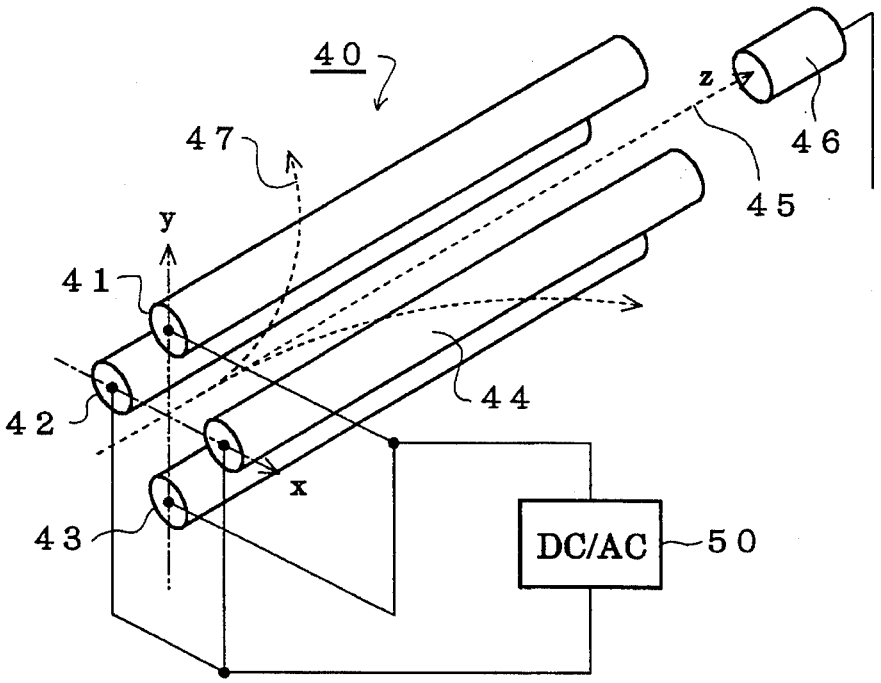
FIG. 5 is an explanatory view of a quadrupole unit and the movement of ions.

The fourth embodiment of the present invention is shown in FIG. 4, in which a quadrupole unit 11 is clamped by two pairs of heat sink plates 31, 32 and 33, 34. The separate heat sink plates 31, 32, 33, 34 of the present embodiment are further resilient to a mal-alignment of the ceramic holders 13, 14: that is, they do not exert a skewing force on the four rod electrodes 12 when the contacting faces 13a, 13b, 14a, 14b of the quadrupole holders 13, 14 are uneven. It is also possible in the present embodiment to use fluid cooling system or Peltier heat pump units as shown in FIGS. 3A or 3B.

What is claimed is:

1. A quadrupole mass analyzer comprising:

four rod electrodes placed in parallel to and symmetrically around a center axis;

a pair of non-conductive holders for holding the four rod electrodes at both ends of the four rod electrodes; and a pair of heat sink plates and a unit of spring means for clamping the non-conductive holders.

2. The quadrupole mass analyzer according to claim 1, wherein two parallel planes are formed on each of the nonconductive holders and surfaces of the heat sink plates for contacting the non-conductive holders are flat.

3. The quadrupole mass analyzer according to claim 1, wherein the heat sink plates are set to contact a wall of a metal case of the quadrupole mass analyzer.

4. The quadrupole mass analyzer according to claim 1, wherein a fluid heat exchanger is provided on an outer surface of each of the heat sink plates.

5. The quadrupole mass analyzer according to claim 3, wherein a Peltier heat pump unit is used to actively draw heat from each of the heat sink plates to the wall of the metal case of the quadrupole mass analyzer.

6. The quadrupole mass analyzer according to claim 1, wherein the heat sink plates are made of copper.

7. The quadrupole mass analyzer according to claim 1, wherein the heat sink plates are made of aluminum.

8. A quadrupole mass analyzer comprising:

four rod electrodes placed in parallel to and symmetrically around a center axis;

a pair of non-conductive holders for holding the four rod electrodes at both ends of the four rod electrodes; and two pairs of heat sink plates and two units of spring means, each for clamping one of the non-conductive holders.

9. The quadrupole mass analyzer according to claim 8, wherein two parallel planes are formed on each of the nonconductive holders and surfaces of the heat sink plates for contacting the non-conductive holders are flat.

10. The quadrupole mass analyzer according to claim 8, wherein a fluid heat exchanger is provided on an outer surface of each of the heat sink plates.

11. The quadrupole mass analyzer according to claim 8, wherein the heat sink plates are made of copper.

12. The quadrupole mass analyzer according to claim 8, wherein the heat sink plates are made of aluminum.

* * * * *